US005771622A

United States Patent [19]

Koziuk et al.

[11] Patent Number: 5,771,622

[45] Date of Patent: Jun. 30, 1998

[54] FIREARM SIGHTING ASSEMBLY

[76] Inventors: Richard Koziuk, 9 Cedar Dr., Plainview, N.Y. 11803; Henry Teja, 74 Tyrconnell Ave., Massapeque Park, N.Y. 11762

[21] Appl. No.: 382,443

[22] Filed: Feb. 2, 1995

[51] Int. Cl.[6] ..... F41C 23/00

[52] U.S. Cl. ..... 42/74

[58] Field of Search ..... 42/71.01, 74, 90, 42/96, 106

[56] References Cited

U.S. PATENT DOCUMENTS

| | | | |
|---|---|---|---|
| 1,973,811 | 9/1934 | Jessup | 42/74 |
| 2,282,428 | 5/1942 | Rigandi | 42/74 |
| 2,451,473 | 10/1948 | Cooper | 42/74 |
| 4,120,108 | 10/1978 | Vickers et al. | 42/74 |
| 4,433,500 | 2/1984 | Kunevicius | 42/74 |
| 5,265,365 | 11/1993 | Finn | 42/74 |

*Primary Examiner*—Stephen C. Bentley

*Attorney, Agent, or Firm*—Allen R. Morganstern

[57] ABSTRACT

This invention relates to a new and improved design associated with the fabrication and construction of a firearm sighting assembly. In accordance with the invention, the firearm sighting assembly defines a detachable structure capable of being affixed to the stock of a rifle wherein interchangeable elevational elements provide a stationery pedestal for enabling a marksman to aim the firearm while there is mounted upon the firearm a telescopic sight. By having the firearm sighting assembly consist of a mounting structural component having an opening therethrough and upon which strap members and buckle elements are attached to enable the selective mounting thereof upon the stock of a firearm, and an elevational element capable of protruding through the opening formed within the mounting structural component and capable of mechanically interfitting therewith in an interchangeable fashion, there is achieved the ability to provide a firearm sighting assembly that is readily attachable to a firearm as well as providing an adjustable pedestal from which one is able to aim a firearm that has mounted thereon a telescopic sight.

6 Claims, 2 Drawing Sheets

FIREARM SIGHTING ASSEMBLY

BACKGROUND AND OBJECTS OF THE INVENTION

This invention relates to a new and improved design associated with the fabrication and construction of a firearm sighting assembly. In accordance with the invention, firearms, and more particularly, rifles, have been fitted to receive a telescopic sight to assist a marksman aim at an object at a great distance and to otherwise hit said object upon firing of the firearm. Most mounted telescopic sights are elevated above the top of the rifle barrel. As a result, upon a marksman placing his cheek against the rifle stock to aim the rifle as would be the case when no such telescopic sight is mounted upon the rifle, the marksman is unable to properly align his eye with the telescopic sight while utilizing the stock as a stationery pedestal for aiming.

Although there is known in the prior art, devices capable of being mounted upon the stock of a rifle which could possibly assist in the aiming of the rifle, with or without a telescopic sight mounted thereon, none of the prior art devices address themselves to the specific structure, advantages and expediencies associated with the present invention.

With regard to said prior art which addresses itself to the subject matter of the present invention, it should be noted that the following patents evidence relevant structures, however, same do not anticipate nor otherwise teach the present invention. More particularly, the prior art referred to above is as follows: U.S. Pat. No. 2,282,428, entitled "Attachment for Firearms", issued to Rigandi on May 12, 1942; U.S. Pat. No. 2,451,473, entitled "Cheek Pad for Firearms", issued to Cooper on Oct. 19, 1948; U.S. Pat. No. 4,120,108, entitled "Gun Stock Covers", issued to Vickers on Oct. 17, 1978; U.S. Pat. No. 4,433,500, entitled "Gun Glove", issued to Kunevicius on Feb. 28, 1984; U.S. Pat. No. 1,973,811, entitled "Gun Attachment", issued to Jessup on Sep. 18, 1934; U.S. Pat. No. 5,265,365, entitled "Pouch and Cheek Piece for Long Guns", issued to Finn on Nov. 30, 1993.

In keeping with the invention, it is a specific object thereof to create a firearm sighting assembly that is simple in construction and whose use is facilitated by its design.

It is another object of the present invention to create a new and improved firearm sighting assembly wherein the assembly is capable of being readily attached to and otherwise removed from the stock of a firearm.

It is another object of the present invention to create a new and improved firearm sighting assembly wherein the assembly is capable of providing adjustable positions above the top of the stock of a firearm so as to aid in the aiming of the firearm.

It is another object of the present invention to create a new and improved firearm sighting assembly wherein the firearm sighting assembly enables one to utilize a telescopic sight with the firearm and assist in the aiming of the firearm upon utilizing such a telescopic sight.

It is another object of the present invention to create a new and improved firearm sighting assembly wherein the firearm sighting assembly is capable of being mounted upon any firearm stock without the need of modification and/or alteration.

The objects and advantages of the invention are set forth in part herein and in part will be obvious herefrom, or may be learned by practice of the invention, the same being realized and attained by means of the instrumentalities and combinations pointed out in the appended claims.

The invention consists of the novel parts, constructions, arrangements, combinations and improvements herein shown and described.

DESCRIPTION OF A PREFERRED EMBODIMENT

Figures 1, 2, 3, 7:
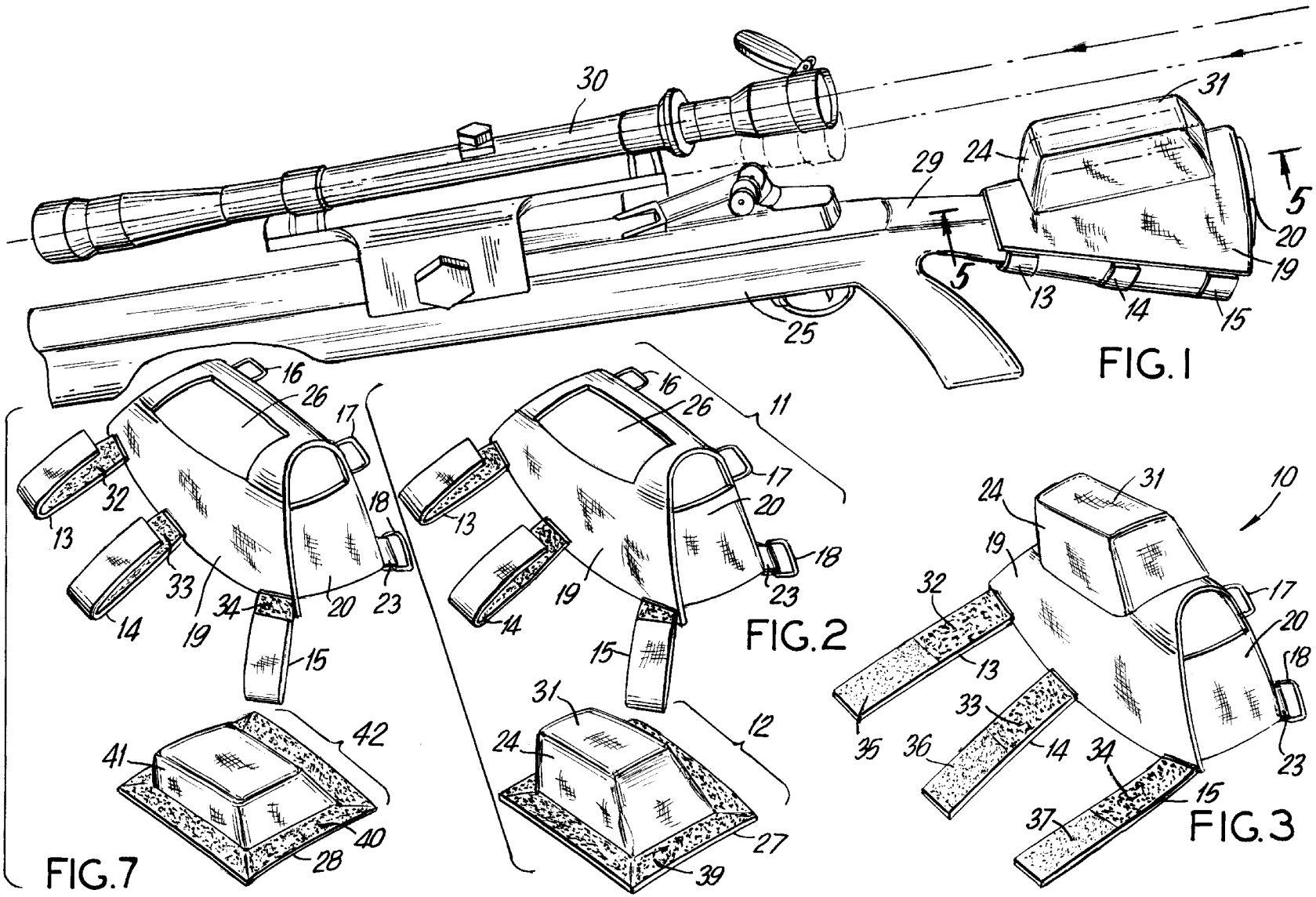
FIG. 1 is a three (3) dimensional perspective view of a firearm sighting assembly constructed in accordance with the invention mounted upon the stock of a rifle having a telescopic sight mounted thereon.
FIG. 2 is a three (3) dimensional perspective view of a firearm sighting assembly constructed in accordance with the invention depicting the elevational element detached from the mounting structure of the firearm sighting assembly.
FIG. 3 is a three (3) dimensional perspective view of a firearm sighting assembly constructed in accordance with the invention wherein the elevational element thereof is in mechanical interfit with the mounting structure of the firearm sighting assembly.
FIG. 7 is a three (3) dimensional perspective view of an alternative embodiment of elevational element 12 as depicted in FIG. 2.

Reference is now herein made to FIG. 3 wherein there is depicted a three-dimensional perspective view of firearm sighting assembly 10 constructed in accordance with the invention.

As depicted in FIG. 3, firearm sighting assembly 10 comprises two separate and distinct components as more readily evidenced in FIG. 2, namely mounting structure 11 and elevational element 12. As depicted in FIG. 2, mounting structure 11 comprises strap members 13, 14 and 15, buckle elements 16, 17 and 18, base member 19 and end member 20.

Figure 4:
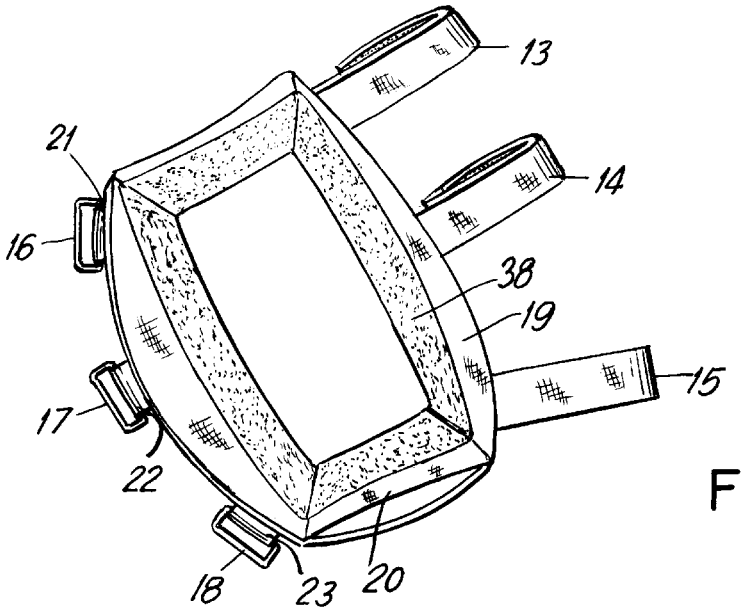
FIG. 4 is a three (3) dimensional perspective bottom view of the mounting structure depicted in FIG. 2.

As further evidenced in FIG. 2, base member 19 has structurally affixed to it as therein depicted either by sewing or by other means one end of strap member 13, one end of strap member 14 and one end of strap member 15. Additionally, buckle elements 16, 17 and 18 are structurally affixed to base member 19 by loop members 21, 22 and 23 respectively (as depicted in FIG. 4). Additionally, base member 19 defines an opening 26 capable of having passed therethrough in accordance with the invention as will be more fully set forth hereinafter, mounting element 24 of elevational element 12. Additionally, end member 20 is structurally affixed to base member 19 as illustrated in FIG. 2.

In further keeping with the invention, strap members 13, 14 and 15 as depicted in FIGS. 2 and 3, have affixed to a portion of the outer surface thereof hook and pile fastener strips. The affixing of said hook and pile fastener strips to strap members 13, 14 and 15 respectively is such that for one-half of the length of strap members 13, 14 and 15 respectively that are adjacent to base member 19, said hook and pile fastener structure is of one configuration, namely a hook fastener structure, while the remaining portion of strap members 13, 14 and 15 respectively have affixed on the same surface thereof the pile fastener structure. As a result, upon strap members 13, 14 and 15 being folded back on their respective surfaces to which the hook and pile fastener configurations are respectively attached as illustrated in FIG. 2, there will result as to each respective strap member a mechanical interfit with itself so as to provide a fastening in a loop fashion of the respective strap members to themselves. As illustrated in FIG. 3, strap members 13, 14 and 15 respectively have affixed thereon as to one half of their respective length which is adjacent to base member 19, hook fastener strips 32, 33 and 34 respectively. As to the remaining one half of strap members 13, 14 and 15, respectively, there is affixed thereto as illustrated in FIG. 3 pile fastener strips 35, 36 and 37 respectively. Although any number of well- known prior art hook and pile fastener means are capable of being utilized in accordance with the invention, one such hook and pile fastener means capable of utilization in accordance with the invention is commonly known in the market place by its trademark, to wit, VELCRO®.

In further keeping with the invention and as illustrated in FIGS. 2 and 3, strap members 13, 14 and 15 are structurally affixed to base member 19 by sewing the composition of the material comprising strap members 13, 14 and 15 to the composition of material utilized with regard to base member 19. Similarly, loop members 21, 22 and 23 as illustrated in FIG. 4 are also structurally affixed to base member 19 by having the respective ends thereof sewn to base member 19. As further depicted in FIGS. 2 and 3, buckle elements 16, 17 and 18 are of a rectangular closed loop construction and are contained within the structure of loop members 21, 22 and 23 respectively as therein depicted and are thus structurally affixed to base member 19. In keeping with the invention, strap members 13, 14 and 15, loop members 21, 22 and 23, base member 19, and end member 20 can all be constructed from a webbed type fabric material or from any other composition of fabric or material that is pliable as well as evidences structural strength.

As further illustrated in FIG. 2, elevational element 12 has structurally affixed about its base member 27, hook fastener element 39 of the hook and pile fastener structure utilized in accordance with the invention, be it VELCRO®, or otherwise while the pile fastener element 38 of said hook and pile fastener structure is structurally affixed to the inner surface of base member 19 that surrounds opening 26 formed therein as depicted in FIG. 4. As a result of the interconnecting fit between hook fastener element 39 affixed to base member 27 of elevational element 12 and pile fastener element 38 affixed to the interior surface of base member 19 that surrounds opening 26 as formed therein and as illustrated in FIGS. 2 and 4, upon the insertion of mounting element 24 of elevational element 12 through opening 26 such that hook fastener element 39 comes in contact with pile fastener element 38, there is readily achieved the creation of firearm sighting assembly 10 utilizing mounting element 24 which is of a specific height as determined by the height of mounting element 24 of elevational element 12.

As depicted in FIG. 1, firearm sighting assembly 10 has been mounted upon rifle 25 in accordance with the invention wherein strap members 13, 14 and 15 respectively have been fed through buckle elements 16, 17 and 18 respectively and folded back on themselves so as to allow for the mechanical interfit between hook fastener strip 32 with pile fastener strip 35 of strap member 13, hook fastener strip 33 with pile fastener strip 36 of strap member 14 and hook fastener strip 34 with pile fastener strip 37 of strap member is so as to result in the mechanical mounting of firearm sighting assembly 10 upon the stock of rifle 25.

As further depicted in FIG. 1, mounting element 24 of firearm sighting assembly 10 is placed in alignment in accordance with the invention above stock 29 of rifle 25 with telescopic sight 30 in such a manner so as to allow for a marksman to place a portion of his face, be it a cheek or otherwise, against mounting element 24 of firearm sighting assembly 10 so as to align the marksman's eye with the axis of telescopic sight 30 so as to facilitate the sighting and/or aiming of rifle 25.

In keeping with the invention, mounting element 24 of elevational element 12 can be of various sizes so as to provide a selected variation in the vertical distance between the top surface 31 of mounting element 24 as compared to the top of stock 29. By being able to vary the height of mounting element 24, there is provided the flexibility of adjusting firearm sighting assembly 10 to meet the various mounting configurations of a telescopic sight 30 as well as providing adjustment based upon the particular configuration of the stock 29 of rifle 25 and as well as providing for adjustment to meet the personal characteristics and shooting preferences of the marksman utilizing the device.

The means by which the variation in height of mounting element 24 occurs is by utilizing separate and distinct elevational elements constructed in accordance with elevational element 12, but having variations in the height of mounting element 24.

Because of the ability to remove elevational element 12 from base member 19 of mounting structure 11 due to the detachable interfit between hook fastener element 39 affixed to base member 27 of base member 19 (FIG. 2) and pile fastener element 38 of base member 19 (FIG. 4), there is achieved the ability to selectively insert various elevational elements 12, in combination with base member 19 so as to vary the height of fire arm sighting assembly 10.

In accordance with the above, there is depicted in FIG. 7 mounting structure 11 identical to its appearance in FIG. 2, however, elevational element 12, as depicted in FIG. 2, is modified in accordance with this invention as illustrated in FIG. 7 and an alternative embodiment thereof is illustrated. More particularly, as depicted in FIG. 7, elevational element 42 is illustrated and is otherwise identical in structure of that of elevational element 12, as depicted in FIG. 2, except elevational element 42 has mounting element 41 whose height is less than that of mounting element 24 as illustrated in FIG. 2. In keeping with the invention, base member 40 of elevational element 42 has structurally affixed thereto as illustrated in FIG. 7 hook fastener element 28 identical in structure to hook element 39 of elevational element 12 as illustrated in FIG. 2.

In keeping with the invention and as related to FIG. 7, should a marksman desire to utilize fire arm sighting assembly 10 but to have fire arm sighting assembly 10 not provide a top surface 31 as high above stock 29 of rifle 25 as depicted in FIG. 1, then, elevational element 42 as depicted in FIG. 7 would be utilized in place of elevational element 12 as related to its intercoupling with mounting structure 11 as set forth above.

In further keeping with the invention, it should be noted that elevational element 12 can be fabricated such that mounting element 24 as well as mounting element 41 can be fabricated from a solid block of material be it of a rubberized material or otherwise or can be fashioned so as to provide a hollow cavity within which there can be stuffed prior to structurally affixing mounting element 24 and or mounting element 41 upon base member 27 and/or base member 40 respectively with any form of compressible, resilient material, be it foam rubber, granulated particles and/or the like, the important feature and/or characteristic being such that mounting element 24 and mounting element 41 are capable of providing to a marksman a defined, comfortable surface upon which a marksman can place a portion of their face as desired so as to assist in aiming a rifle upon which has been mounted a telescopic sight.

Figure 5:
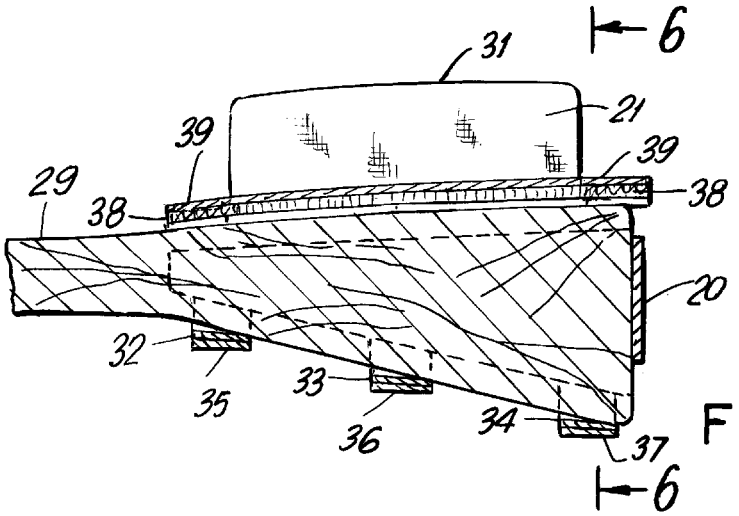
FIG. 5 is a partial cross-sectional view of a firearm sighting assembly constructed in accordance with the invention as taken along lines 5—5 of FIG. 1.

It should further be noted that FIG. 5 depicts a partial cross-sectional view of FIG. 1 taken along lines 5—5 so as to depict a partial cross cut of fire arm sighting assembly 10 as mounted upon stock 29 of rifle 25.

Figure 6:
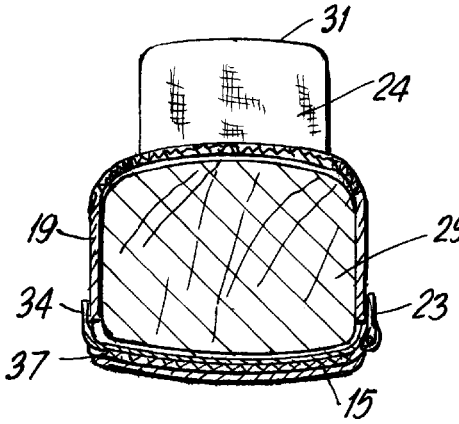
FIG. 6 is a cross-sectional view of the firearm sighting assembly taken along lines 6—6 of FIG. 5.

Additionally, FIG. 6 illustrates a cross-sectional view of fire arm sighting assembly 10 as depicted in FIG. 5 taken along lines 6—6 thereof so as to illustrate a partial cross-cut view of fire arm sighting assembly 10 as mounted upon stock 29 of rifle 25.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

We claim:

1. A firearm sighting assembly capable of being mounted upon the stock of a rifle comprising:

a. a mounting structure comprising
(1) a base member defining an opening;
(2) an end member structurally affixed to said base member;
(3) loop fastener means structurally affixed to the under surface of said base member surrounding the opening formed in said base member;
(4) means to selectively structurally affix said mounting structure to the stock of a rifle;

b. an elevational element comprising
(1) a base member;
(2) a mounting element structurally affixed to said base member so as to define on the surface of said base member a border surface not covered by said mounting element, said mounting element being shaped so as to compatably fit through the opening formed in said base member and to protrude above the surface of said base member;
(3) hook fastener means structurally affixed to the surface of said base member not covered by said mounting element and capable of selective mechanical interfit with said loop fastener means structurally affixed to the under surface of said base member of said mounting structure such that upon the insertion of said mounting element through the opening formed in said base member of said mounting structure said hook fastener means structurally affixed to said base member of said elevational element comes into contact with the loop fastener means structurally affixed to the under surface of said mounting structure so as to structurally affix in a selected fashion said elevational element to said mounting structure.

2. A firearm sighting assembly capable of being mounted upon the stock of a rifle comprising:

a. a mounting structure comprising
(1) a base member defining an opening;
(2) an end member structurally affixed to said base member;
(3) loop fastener means structurally affixed to the under surface of said base member surrounding the opening formed in said base member;
(4) strap members structurally affixed to said base member;
(5) hook fastener strips structurally affixed to a portion of one surface of each of said strap members;
(6) pile fastener strips structurally affixed to the remaining portion of the one surface of each of said strap members to which said hook fastener strips are not affixed so that upon said hook fastener strips coming into physical contact with said pile fastener strips there is provided a mechanical interlock therebetween;
(7) loop members defining a closed loop structurally affixed to said base member opposite to and in alignment with said strap members;
(8) buckle elements defining a closed loop capable of having said loop member passing through the closed loop of each of said buckle elements so as to allow for the feeding through said buckle elements of said strap members; and b. an elevational element comprising
(1) a base member;
(2) a mounting element structurally affixed to said base member so as to define on the surface of said base member a border surface not covered by said mounting element, said mounting element being shaped so as to compatably fit through the opening formed in said base member and to protrude above the surface of said base member;
(3) hook fastener means structurally affixed to the surface of said base member not covered by said mounting element and capable of selective mechanical interfit with said loop fastener means structurally affixed to the under surface of said base member of said mounting structure such that upon the insertion of said mounting element through the opening formed in said base member of said mounting structure said hook fastener means structurally affixed to said base member of said elevational element comes into contact with the loop fastener means structurally affixed to the under surface of said mounting structure so as to structurally affix in a selected fashion said elevational element to said mounting structure.

3. A firearm sighting assembly capable of being mounted upon the stock of a rifle as set forth in claim 2 wherein three (3) strap members are utilized, three (3) loop members are utilized and three (3) buckle elements are utilized.

4. A firearm sighting assembly capable of being mounted upon the stock of a rifle as set forth in claim 2 wherein the hook fastener strips and pile fastener strips are comprised of Velcro®.

5. A firearm sighting assembly capable of being mounted upon the stock of a rifle as set forth in claim 2 wherein said mounting element of said elevational element is of a unitary structure fabricated from a resilient material.

6. A firearm sighting assembly capable of being mounted upon the stock of a rifle as set forth in claim 2 wherein said mounting element of said elevational element defines a hollow cavity which is stuffed with a resilient material.

* * * * *